US009722293B2

(12) United States Patent
Asai

(10) Patent No.: US 9,722,293 B2
(45) Date of Patent: Aug. 1, 2017

(54) COMMUNICATION DEVICE PROVIDED WITH ANTENNA FOR NEAR FIELD WIRELESS COMMUNICATION

(71) Applicant: BROTHER KOGYO KABUSHIKI KAISHA, Nagoya-shi, Aichi-ken (JP)

(72) Inventor: Yasuhiro Asai, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 172 days.

(21) Appl. No.: 14/664,636

(22) Filed: Mar. 20, 2015

(65) Prior Publication Data

US 2015/0280306 A1 Oct. 1, 2015

(30) Foreign Application Priority Data

Mar. 27, 2014 (JP) ..... 2014-066245

(51) Int. Cl.

| | |
|---|---|
| ***H01Q 1/22*** | (2006.01) |
| ***H01Q 1/06*** | (2006.01) |
| ***H01Q 7/00*** | (2006.01) |
| ***H01Q 1/52*** | (2006.01) |

(52) U.S. Cl.

CPC ..... *H01Q 1/06* (2013.01); *H01Q 1/22* (2013.01); *H01Q 1/2216* (2013.01); *H01Q 1/526* (2013.01); *H01Q 7/00* (2013.01)

(58) Field of Classification Search

CPC ..... H01Q 1/22; H01Q 1/2216; H01Q 7/00

See application file for complete search history.

(56) References Cited

U.S. PATENT DOCUMENTS 7,631,809 B2 * 12/2009 Mott ..... G06K 7/0004 235/435
9,509,873 B2 * 11/2016 Matsushima ..... H04N 1/00559
2015/0029540 A1 * 1/2015 Jo ..... G06F 3/1209 358/1.15

FOREIGN PATENT DOCUMENTS

| | | | |
|---|---|---|---|
| JP | 2003-229708 | A | 8/2003 |
| JP | 2005-084794 | A | 3/2005 |
| JP | 2006-323615 | A | 11/2006 |
| JP | 2007-072848 | A | 3/2007 |
| JP | 2007-157177 | A | 6/2007 |
| JP | 2008-276372 | A | 11/2008 |
| JP | 2010-087648 | A | 4/2010 |
| JP | 2010-178205 | A | 8/2010 |
| JP | 2011-100309 | A | 5/2011 |
| JP | 2014-021638 | A | 3/2014 |

OTHER PUBLICATIONS

Office Action issued in corresponding Japanese Patent Application No. 2014-066245, Dec. 13, 2016.
Office Action issued in corresponding Japanese Patent Application No. 2014-066245, Dec. 20, 2016.

* cited by examiner

*Primary Examiner* — Hoang Nguyen
(74) *Attorney, Agent, or Firm* — Merchant & Gould P.C.

(57) ABSTRACT

A communication device includes a communication board; an antenna; a light-emitting element; and a connecting wire. The antenna is for near field wireless communication, and is provided on the communication board. The light-emitting element is provided on the communication board at a position away from the antenna. The connecting wire is provided on the communication board at a position away from the antenna and is connected to the light-emitting element.

14 Claims, 9 Drawing Sheets

COMMUNICATION DEVICE PROVIDED WITH ANTENNA FOR NEAR FIELD WIRELESS COMMUNICATION

CROSS REFERENCE TO RELATED APPLICATION

This application claims priority from Japanese Patent Application No. 2014-066245 filed Mar. 27, 2014. The entire content of the priority application is incorporated herein by reference.

TECHNICAL FIELD

The present disclosure relates to a technique for using light to indicate a region where an antenna for near field wireless communication is disposed.

BACKGROUND

A structure for illuminating an area near an antenna that transmits data to or receives data from storage media such as IC cards and the like has been known in information equipment that transmits data to or receives data from the storage media in a non-contact manner (see Japanese Patent Application Publication No. 2006-323615). In the case of the conventional structure, the light emitted from a light-emitting element mounted on a printed board that is different from that on which the antenna is mounted is led to a substantially center position of a front side of the antenna via a light guide path.

SUMMARY

However, in the conventional structure described above, a communication board on which the antenna is disposed is different from the printed board on which the light-emitting element is disposed. Therefore, it is difficult to make a communication device such as information equipment and the like smaller in size. Meanwhile, if the antenna and the light-emitting element are disposed on the same board without carefully studying the positional relation between the antenna and the light-emitting element, the communication state of the antenna could be worsened due to the light-emitting element.

In view of the foregoing, it is an object of the disclosure to provide a technique capable of making a communication device smaller in size while preventing its communication state from being worsened.

In order to attain the above and other objects, the disclosure provides a communication device that includes a communication board; an antenna; a light-emitting element; and a connecting wire. The antenna is for near field wireless communication, and is provided on the communication board. The light-emitting element is provided on the communication board at a position away from the antenna. The connecting wire is provided on the communication board at a position away from the antenna and is connected to the light-emitting element.

According to another aspect, the disclosure provides an image forming apparatus that includes a communication device; and an image processing unit. The communication device includes a communication board; an antenna; a light-emitting element; and a connection wire. The antenna is for near field wireless communication, and is provided on the communication board. The light-emitting element is provided on the communication board at a position away from the antenna. The connecting wire is provided on the communication board at a position away from the antenna, and is connected to the light-emitting element. The image processing unit is configured to perform at least one of reading images and forming images.

BRIEF DESCRIPTION OF THE DRAWINGS

The particular features and advantages of the invention as well as other objects will become apparent from the following description taken in connection with the accompanying drawings, in which.

DETAILED DESCRIPTION

First Embodiment

Figure 1:
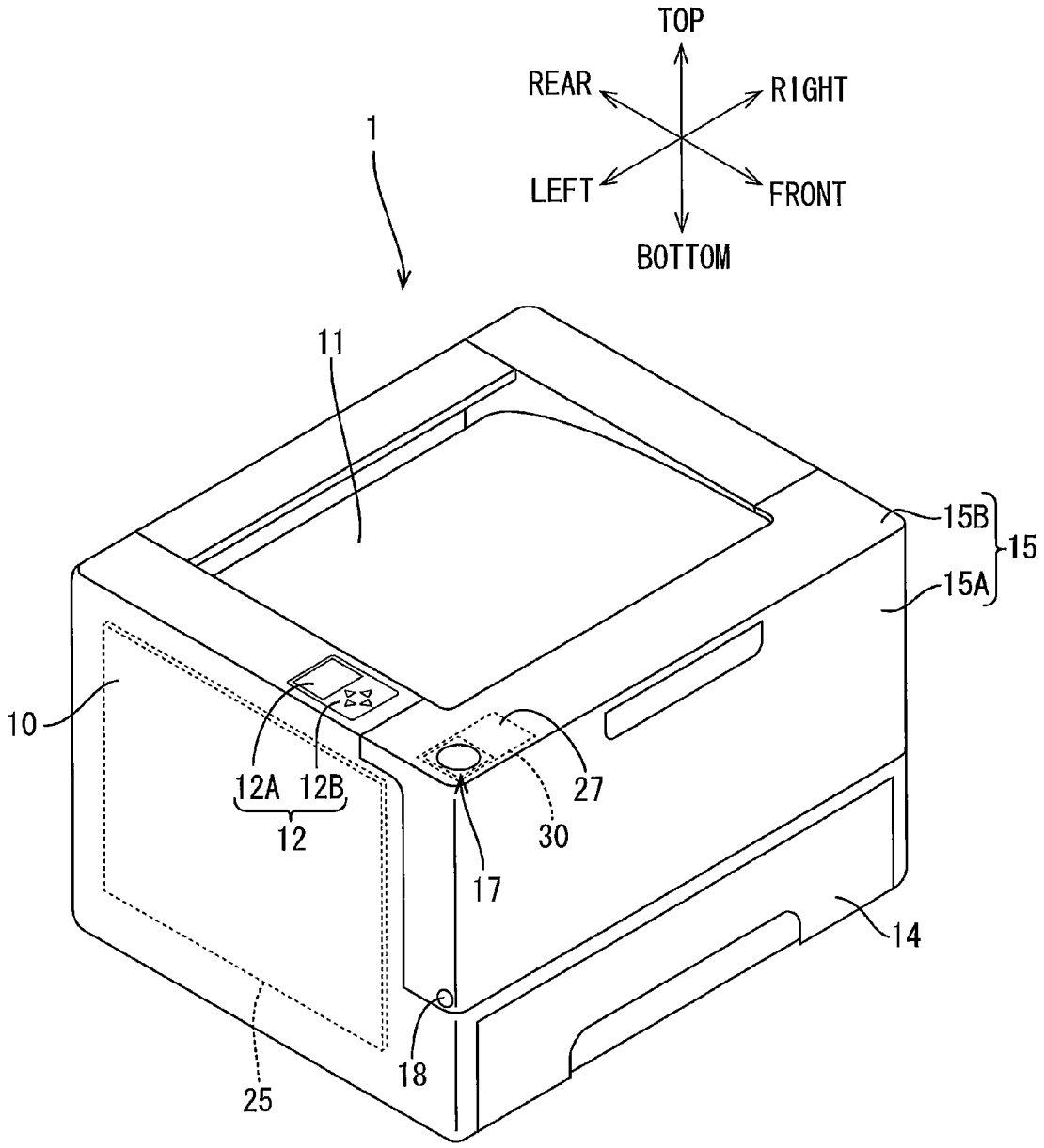
FIG. 1 is a perspective diagram of a printer.

A printer 1 according to a first embodiment will be described while referring to FIGS. 1 to 7.

(1) Function of Printer

The printer 1 is an example of the image forming apparatus. The printer 1 is configured to be connectable to external devices such as personal computers and the like through a communication interface unit 76 described below (see FIG. 7), and to form images on sheets based on image forming commands received from the external devices.

In addition, the printer 1 is configured to perform near field wireless communication at short distances of up to approximately 10 cm with mobile terminals such as smartphones, authentication cards, and the like. Near field wireless communication can be utilized for purposes such as (a) to (c) as follows:

(a) Sending authentication information from the mobile terminals to the image forming apparatus.

(b) Sending image forming commands from the mobile terminals to the image forming apparatus.

(c) Operating the image forming apparatus from the mobile terminals.

Note that the purpose for which near field wireless communication is utilized can be freely decided as appropriate.

With the present embodiment, examples are described in which Near Field Communication (hereinafter referred to as NFC) is utilized as the near field wireless communication method described above. NFC is an international standard for near field wireless communication advised as ISO/IEC 21481 or ISO/IEC 18092. Wireless communication generally includes radio wave types and electromagnetic induction types, and NFC performs wireless communication using an electromagnetic induction type.

Next, the exterior of the printer 1 will be described. The printer 1 has a housing 10 made of resin. The housing 10 is formed into a substantially box-like shape with a discharge tray 11 in an upper portion. An operating panel 12 is provided at a left side of the discharge tray 11. The operating panel 12 includes a display device 12A such as a liquid crystal display, various operation buttons 12B, and the like. The display device 12A has a display portion and a touch sensor which detects that an object has touched the display portion. In the description hereinafter, the display device 12A with the touch sensor will be referred to as the touch screen 12A.

Users can specify various settings and can input various instructions by manipulating the touch screen 12A and the operation buttons 12B. In addition, when a user holds a mobile terminal near an antenna 35 for near field wireless communication (see FIG. 2), the touch screen 12A displays information to indicate whether or not near field wireless communication has been established successfully.

A control board 25 is provided in an inner left portion of the housing 10. CPU 71, ASIC (Application Specific Integrated Circuit) 75, and other components are mounted on the control board 25 (see FIG. 7). The CPU 71 and the ASIC 75 control an image-forming unit 20 described later.

A sheet tray 14 is provided at a lower portion of the housing 10. The sheet tray 14 accommodates sheets and can be pulled out from the front side of the housing 10. In addition, a front cover 15 is provided at the front surface of the housing 10 and upward of the sheet tray 14. A hinge 18 is provided at a lower end of the front cover 15 and enables the front cover 15 to be opened or closed with respect to the front surface of the housing 10. The front cover 15 is provided to allow a user to carry out maintenance work, such as replacing toner or ink.

The front cover 15 includes a front plate 15A and a top plate 15B. The front plate 15A covers the front surface of the housing 10 when the front cover 15 is in a closed state in which the front cover 15 is closed with respect to the housing 10. The top plate 15B covers an upper surface of the housing 10 when the front cover 15 is in the closed state. When the front cover 15 is in the closed state, the top plate 15B is located closer to the front side than the discharge tray 11, and covers a front end of the upper surface of the housing 10. Here, the front side represents a side at which users are expected to operate the printer 1. Text displayed on the touch screen 12A of the operating panel 12 is displayed in such a way as to allow users to correctly read when the printer 1 is viewed from the front side. Text written on operation buttons 12B is arranged in such a way as to allow users to correctly read when the printer 1 is viewed from the front side at which the users are expected to operate.

A communication unit 30 includes an antenna 35 for near field wireless communication, and is provided at an upper portion of the top plate 15B of the front cover 15, as shown in FIG. 1. The communication unit 30 is provided in a left portion of the top plate 15B, and is disposed further toward a front side than the operating panel 12. The communication unit 30 is an example of the communication device.

Figure 2:
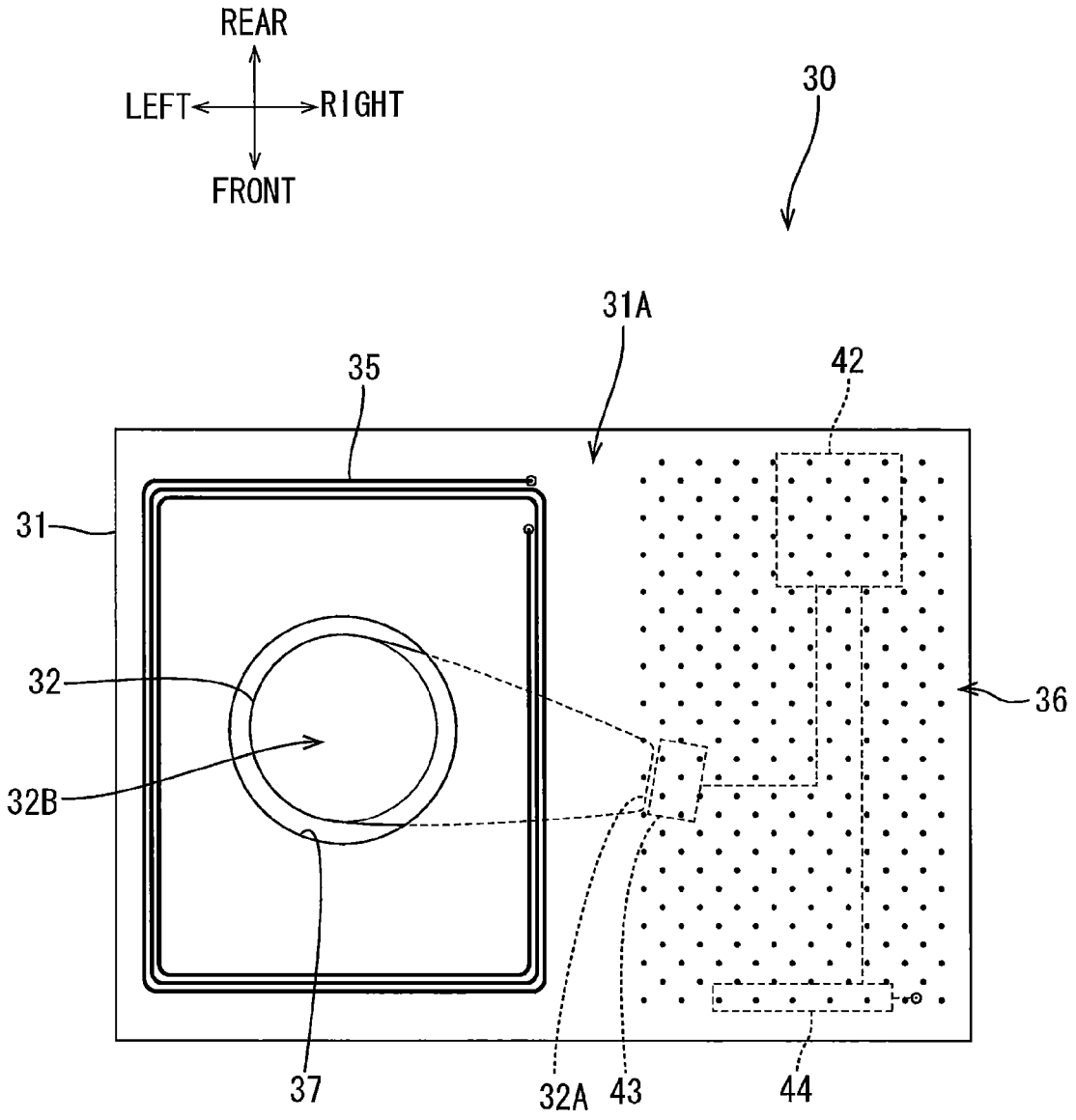
FIG. 2 is a top view of a communication unit.

The communication unit 30 is disposed in the left portion of the top plate 15B in such a way that the antenna 35 is located closer to the left side than a communication circuit 42 (see FIG. 2). Accordingly, when the front cover 15 is in the closed state, the antenna 35 mounted on a communication board 31 (described later) is more likely to be placed away from the discharge tray 11 in the left-right direction compared with the cases where the antenna 35 is disposed on the top plate 15B in such a way as to be placed closer to the right side than the communication circuit 42. This configuration prevents the antenna 35 from being covered with a sheet being discharged onto the discharge tray 11.

Figure 3:
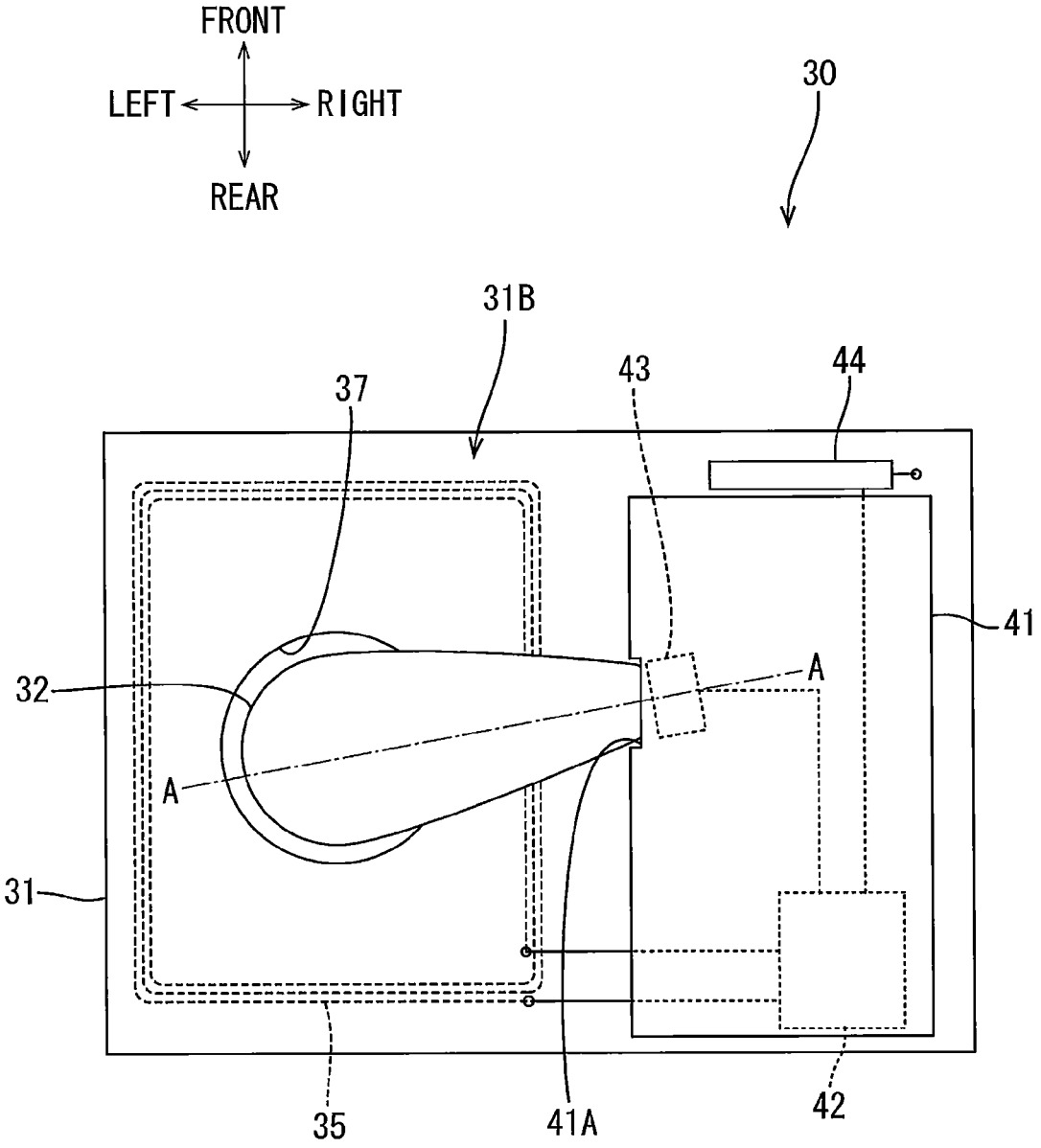
FIG. 3 is a bottom view of the communication unit.

As shown in FIGS. 2 and 3, the communication unit 30 includes the communication board 31 and a light guide member 32. The communication board 31 is rectangular in shape. The loop antenna 35 for near field wireless communication, the communication circuit 42 connected to the antenna 35, LED 43, a connector 44, and the like are mounted on the communication board 31. The antenna 35 is a loop antenna that has a looped shape, and a light transmission hole 37 is formed inside a looped portion of the antenna 35 in such a way as to pass through the communication board 31 between an upper surface 31A and a lower surface 31B. The light guide member 32 is an example of a light guide member. The communication circuit 42 is an example of a communication control unit. The LED 43 is an example of the light-emitting element. The connector 44 is an example of a power input unit. The light transmission hole 37 is an example of an aperture.

The upper surface 31A of the communication board 31 faces upward when the communication board 31 is installed in the printer 1. The antenna 35 is mounted on the upper surface 31A, as shown in FIG. 2. The communication board 31 is disposed in such a way that the long sides thereof face in the left-right direction of the printer 1. The antenna 35 is placed on a left end portion of the upper surface 31A of the communication board 31. A solid pattern 36 is formed on a right end portion of the upper surface 31A of the communication board 31 as a wiring pattern to which a ground voltage is connected. The upper surface 31A of the communication board 31 is an example of one surface of the communication board. The solid pattern 36 is an example of a light-shielding pattern.

The lower surface 31B of the communication board 31 faces downward when the communication board 31 is installed in the printer 1. The communication circuit 42, the LED 43, and the connector 44 are mounted on the lower surface 31B, as shown in FIG. 3. The communication circuit 42, the LED 43, and the connector 44 are disposed on a right end portion of the lower surface 31B of the communication board 31. The communication circuit 42, the LED 43, and the connector 44 are mounted outside the looped portion of the antenna 35 in such a way to avoid the antenna 35. The lower surface 31B of the communication board 31 is an example of another surface of the communication board.

The communication circuit 42 and the LED 43 are covered with a metal shield 41, and the connector 44 is mounted outside the shield 41. On a conventional communication board 31, a shield 41 has been provided to reduce effects of electromagnetic waves generated from a control board 25 and other components. In the present embodiment, the shield 41 covers not only the communication circuit 42 but also the LED 43.

Figure 4:
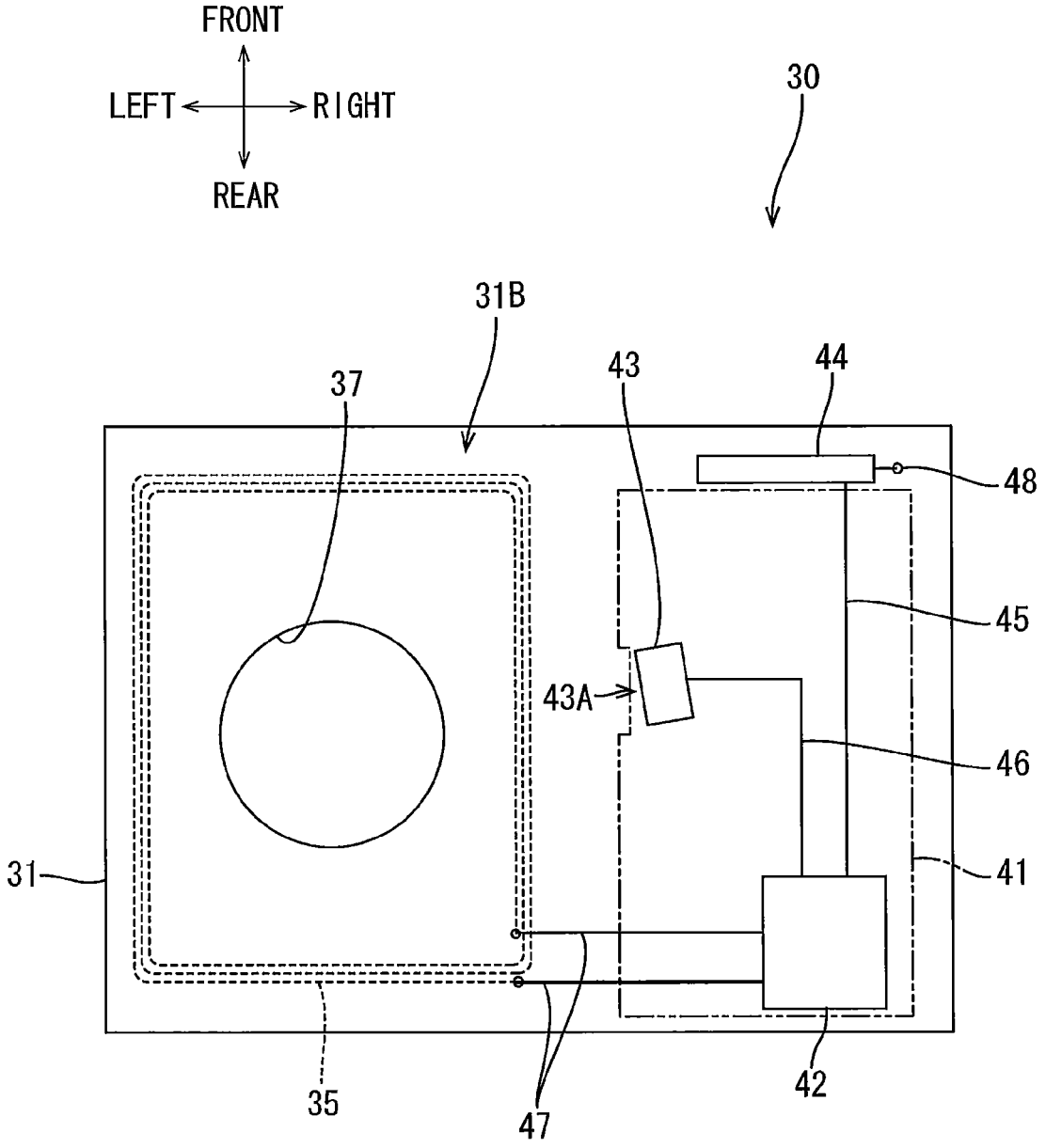
FIG. 4 is a bottom view of a communication board according to a first embodiment.

FIG. 4 shows the lower surface 31B of the communication board 31, with the shield 41 omitted. The connector 44 is connected to the control board 25 via a harness (not shown). The power-supply voltage and ground voltage for driving the communication circuit 42 are input from the control board 25 to the connector 44. The power-supply voltage and ground voltage that are input to the connector 44 are further input to the communication circuit 42 via a wire 45. The ground voltage that is input to the connector 44 is further input to the solid pattern 36 via a through-hole 48 provided in the communication board 31. The shield 41 is an example of a shield member.

The communication circuit 42 is disposed on a right rear end portion of the lower surface 31B of the communication board 31. The communication circuit 42 is driven by the power-supply voltage and ground voltage that are input via the connector 44. The communication circuit 42 is connected to the antenna 35 via wires 47. The communication circuit 42 controls a process of near field wireless communication with a mobile terminal with the use of the antenna 35. The communication circuit 42 uses the antenna 35 to perform near field wireless communication, and outputs the results thereof to the control board 25 via the connector 44. The communication circuit 42 is also connected to the LED 43 via a wire 46. The communication circuit 42 outputs a light emission control signal to the LED 43 for controlling the light emission of the LED 43, such as a current signal whose current value is being controlled. The wire 46 is an example of a connecting wire.

The LED 43 is disposed on a right front end portion of the lower surface 31B of the communication board 31. The LED 43 emits light on the basis of the light emission control signal supplied from the communication circuit 42. The LED 43 is a side-type LED: a light-emitting surface 43A thereof faces leftward along the lower surface 31B of the communication board 31, or toward the antenna 35.

The light-emitting surface 43A of the LED 43 is directed slightly toward the rear direction in conformity with the disposition of the light guide member 32. As a result, the communication circuit 42 is not disposed at the side of the light-emitting surface 43A of the LED 43. The solid pattern 36 is provided in an area of the upper surface 31A of the communication board 31 under which the light-emitting surface 43A of the LED 43 is disposed (see FIG. 2). The solid pattern 36 therefore prevents the light that is emitted by the LED 43 and passes through the communication board 31 from leaking out from the side of the upper surface 31A of the communication board 31.

Incidentally, the wires 45 and 46 are disposed on the right end portion of the lower surface 31B of the communication board 31, as in the case of the communication circuit 42, the LED 43, and the connector 44. The wires 45 and 46 are disposed outside the looped portion of the antenna 35 in such a way as to avoid the antenna 35.

As shown in FIG. 3, the light guide member 32 is disposed on the lower surface 31B of the communication board 31. The light guide member 32 guides the light emitted by the LED 43 to the antenna 35. The light guide member 32 launches the guided light toward the upper surface 31A of the communication board 31 via the light transmission hole 37.

Figure 5:
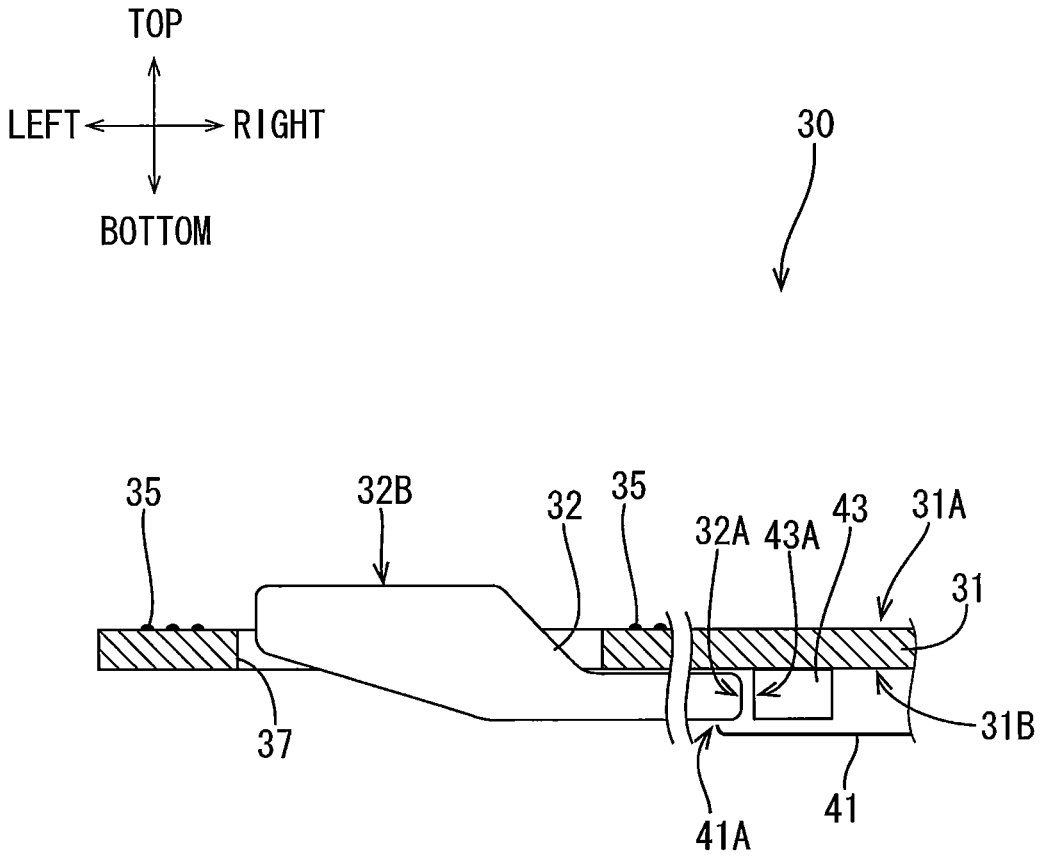
FIG. 5 is a cross-sectional view of the communication unit taken along a line A-A of FIG. 3.

FIG. 5 is a cross-sectional view of the communication unit 30 taken along a line A-A of FIG. 3. As shown in FIG. 5, a cutout portion 41A is formed in the shield 41. The light guide member 32 communicates with the inside of the shield 41 via the cutout portion 41A, and a right end section 32A thereof opposes the light-emitting surface 43A of the LED 43. Accordingly, the light emitted from the LED 43 enters the light guide member 32 through the right end section 32A of the light guide member 32. The right end section 32A of the light guide member 32 is an example of a light incident surface.

The light guide member 32 extends along the lower surface 31B in such a way as to stride over the antenna 35 and get into the looped portion of the antenna 35. A left end portion 32B of the light guide member 32 reaches the light transmission hole 37. Then, the left end portion 32B of the light guide member 32 passes through the light transmission hole 37 from the lower surface 31B to the upper surface 31A, and protrudes in such a way as to be located above the upper surface 31A of the communication board 31. Accordingly, after entering the light guide member 32, the light is output to the upper surface 31A of the communication board 31. The left end portion 32B of the light guide member 32 is an example of a light emission surface.

As shown in FIG. 1, the upper side of the communication unit 30 is covered with a translucent protective cover 27 on the top plate 15B of the front cover 15, thereby making it impossible for a user to directly see the antenna 35. The printer 1 is therefore configured to turn on the LED 43 of the communication unit 30 to emit light when performing near field wireless communication with a mobile terminal. As a result, a region 17 of the protective cover 27 where the inner portion of the antenna 35 is located is illuminated through the light guide member 32. In this manner, the light allows a user to recognize where the antenna 35 is located.

(2) Internal Configuration of Printer

Figure 6:
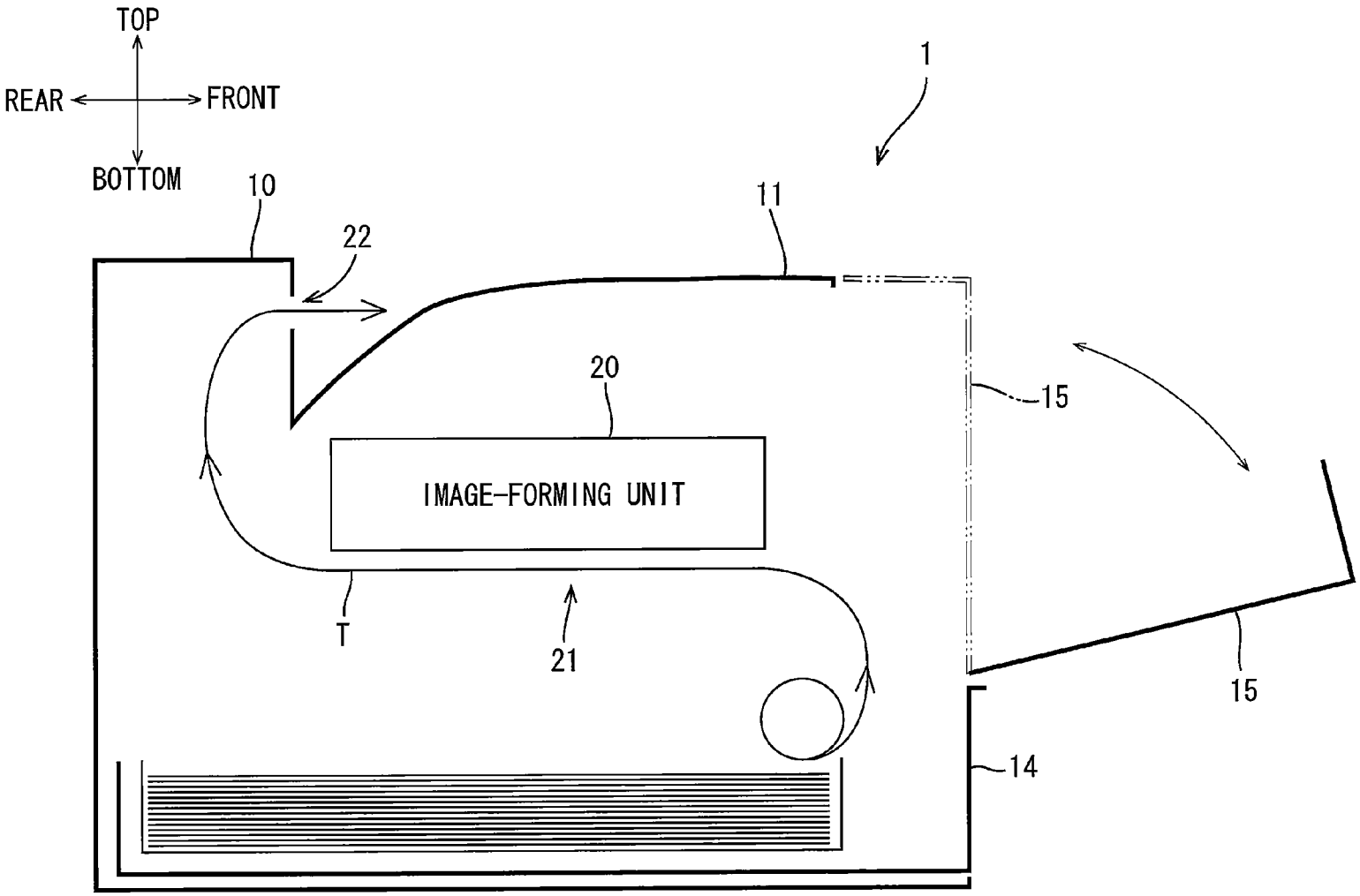
FIG. 6 is a schematic cross-sectional view of the printer.

Next, the internal configuration of the printer 1 will be outlined with reference to FIG. 6. The printer 1 includes the sheet tray 14, the image-forming unit 20, and a conveying unit 21.

The conveying unit 21 includes a plurality of conveying rollers which are shown or not shown in the drawings, and a motor that drives to rotate the conveying rollers. The conveying unit 21 conveys sheets accommodated in the sheet tray 14 one by one along a conveying path T. The image-forming unit 20 forms an image in an electrophotographic or inkjet manner on a sheet conveyed by the conveying unit 21. The conveying unit 21 discharges the sheet on which an image has been formed by the image-forming unit 20 via a discharge port 22 toward the front side of the housing 10. As a result, the sheet is stacked on the discharge tray 11. The image-forming unit 20 is an example of the image processing unit.

(3) Electric Configuration of Printer

Figure 7:
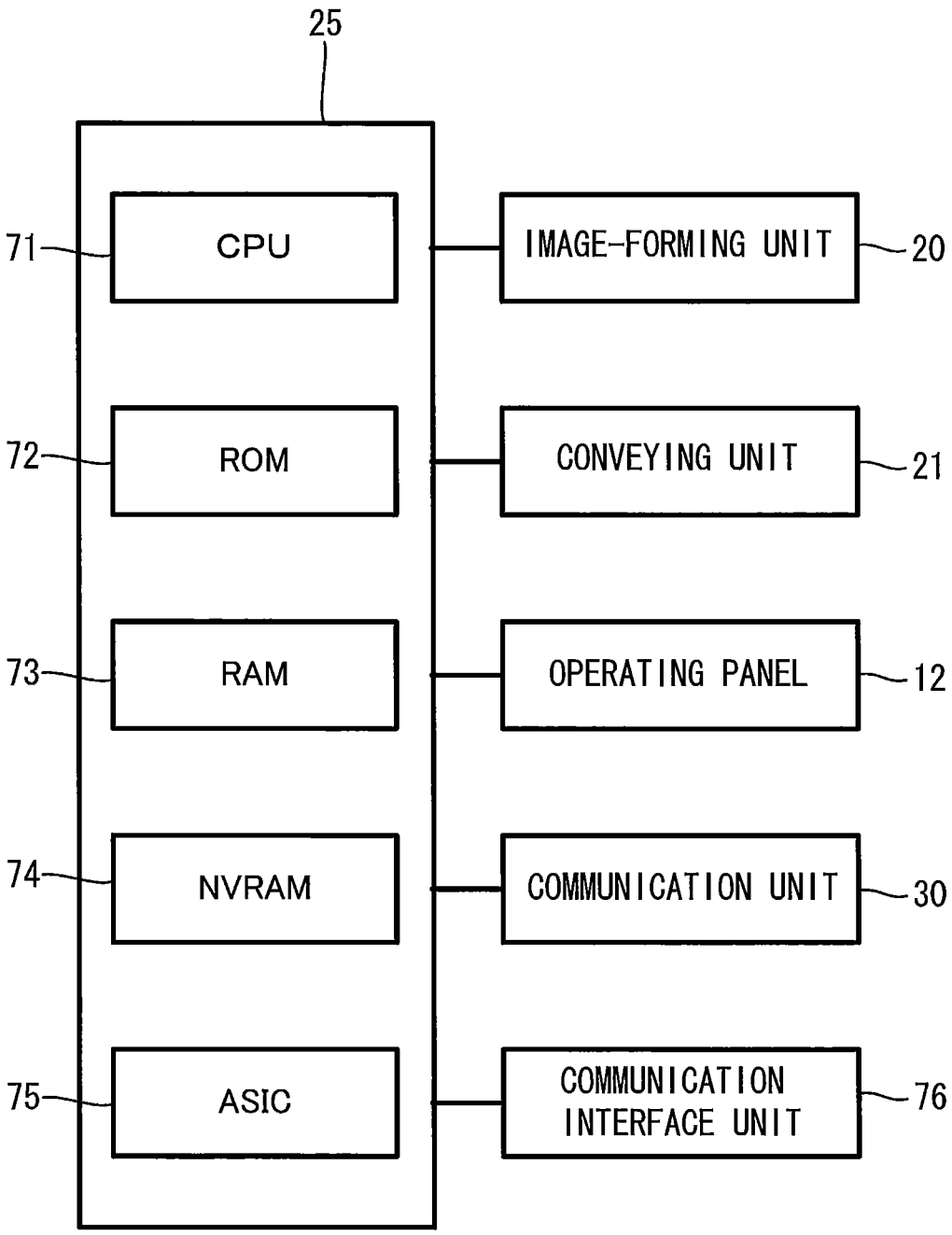
FIG. 7 is a block diagram showing an electric configuration of the printer.

The electric configuration of the printer 1 will be outlined with reference to FIG. 7. The printer 1 includes the CPU 71, a ROM 72, a RAM 73, a NVRAM 74, the ASIC 75, the image-forming unit 20, the conveying unit 21, the operating panel 12, the communication interface unit 76, the communication unit 30, and the like. The CPU 71, ROM 72, RAM 73, NVRAM 74, and ASIC 75 are mounted on the control board 25.

The ROM 72 stores various programs for controlling the operation of the printer 1. The various programs include a program for controlling the image-forming unit 20, for example. The CPU 71 reads the programs from the ROM 72, and controls each part of the printer 1 according to the programs by using hardware circuits such as the ASIC 75 if necessary, while storing the processing results thereof in the RAM 73 or the NVRAM 74.

The communication interface unit 76 communicates with an external device via a communication line such as USB (Universal Serial Bus), LAN (Local Area Network), Internet, and the like.

(4) Advantageous Effects of the First Embodiment

According to the present embodiment described above, the antenna 35 and the LED 43 are mounted on the same communication board 31. Therefore, the communication unit 30 becomes smaller compared with a conventional structure in which the antenna 35 and the LED 43 are mounted on different boards. As a result, the printer 1 can be made smaller in size.

The LED 43 and the wire 46 connected to the LED 43 are disposed outside the antenna 35 in such a way as to avoid the antenna 35. The LED 43 includes metal electrodes internally, and the wire 46 is a metal wire such as a copper wire and the like. Therefore, when the LED 43 and the wire 46 are disposed outside the antenna 35, fewer components including metal are disposed inside the antenna 35 compared with the cases where the LED 43 and the wire 46 are disposed inside the antenna 35. Accordingly, this configuration can prevent the communication state of the antenna 35 from being worsened due to the LED 43 and the wire 46 even when the LED 43 is mounted on the communication board 31.

According to the present embodiment described above, the light emitted by the LED 43 is guided to the antenna 35 by the light guide member 32. Therefore, the LED 43 can be placed away from the antenna 35 compared with cases where no light guide member 32 is provided. As a result, this configuration can prevent the communication state of the antenna 35 from being worsened.

According to the present embodiment described above, the light guide member 32 is disposed in such a way as to stride over the antenna 35. Accordingly, the region 17 of the protective cover 27 corresponding to the inner portion of the antenna 35 can be illuminated without placing the LED 43 inside the antenna 35. In this manner, this configuration improves the visibility of the location of the antenna 35 for a user while preventing the communication state of the antenna 35 from being worsened.

According to the present embodiment described above, the LED 43 is covered with the shield 41. Accordingly, the inner portion of the antenna 35 is illuminated through the light guide member 32, and the leakage of the light from a portion outside the antenna where the LED 43 is placed is suppressed. Further, as the shield 41, a conventional one for covering the communication circuit 42 may be used. Accordingly, a rise in production cost of the communication unit 30 can be reduced.

According to the present embodiment described above, the cutout portion 41A is formed in the shield 41. Therefore, the inner portion of the antenna 35 can be illuminated even when the LED 43 is covered with the shield 41.

According to the present embodiment described above, the LED 43 and the communication circuit 42 are mounted on a different side of the communication board 31 from a side on which the antenna 35 is mounted. This configuration prevents the communication state of the antenna 35 from being worsened compared with cases where the LED 43, the communication circuit 42, and the antenna 35 are mounted on the same side of the communication board 31. Moreover, this configuration allows the LED 43, the communication circuit 42, and the antenna 35 to be placed closer to each other. Accordingly, the communication board 31 can be made smaller in size.

If the LED 43, the communication circuit 42, and the antenna 35 are mounted on the same side of the communication board 31, it is necessary for reducing the influence of the LED 43 and the communication circuit 42 on the communication state of the antenna 35 to separate the LED 43 and the communication circuit 42 from the antenna 35 farther than a reference distance that can reduce the influence on the communication state of the antenna 35 to less than a certain level. In this case, for example, it is necessary to make the length of the long side of the communication board 31 greater than the reference distance, thereby causing the increase of size of the communication board 31.

In the present embodiment, the LED 43 and the communication circuit 42 are mounted on a different side of the communication board 31 from the side on which the antenna 35 is mounted. Therefore, there is no need to separate the LED 43 and the communication circuit 42 from the antenna 35 farther than the reference distance. Thus, the communication board 31 can be made smaller in size.

According to the embodiment described above, the light guide member 32 is mounted on a different side of the communication board 31 from the side on which the antenna 35 is mounted. Meanwhile, the left end portion 32B of the light guide member 32, which is a light emission surface, passes through the light transmission hole 37 and protrudes in such a way as to be located above the upper surface 31A of the communication board 31. Therefore, the region 17 of the protective cover 27 under which the inner portion of the antenna 35 is located can be efficiently illuminated with the use of the light guide member 32 and LED 43 that are mounted on a different side of the communication board 31 from the side on which the antenna 35 is mounted.

According to the embodiment described above, the solid pattern 36 is provided in a region of the upper surface 31A of the communication board 31 under which the light-emitting surface 43A of the LED 43 is disposed. Therefore, this configuration prevents the light emitted from the light-emitting surface 43A of the LED 43 from leaking out from the upper surface 31A of the communication board 31.

Moreover, the solid pattern 36 is used as a ground pattern to which ground voltage is input. This configuration stabilizes the ground voltage used for driving the communication circuit 42 and the power supply voltage that has a certain difference in electrical potential with respect to the ground voltage. Therefore, this configuration prevents the light emitted by the light-emitting surface 43A of the LED 43 from leaking out from the upper surface 31A of the communication board 31 while preventing the communication state of the antenna 35 from being worsened.

According to the present embodiment described above, the antenna 35 is placed away from the communication circuit 42 and the LED 43 in the direction of the long side of the communication board 31 (left-right direction). This configuration prevents the communication state of the antenna 35 from being worsened. Moreover, the communication circuit 42 is placed away from the LED 43 in the direction of the short side of the communication board 31 (front-rear direction). Therefore, this configuration prevents the light emitted by the LED 43 from causing a malfunction of the communication circuit 42.

According to the present embodiment described above, the communication circuit 42 is used to control the light-emitting of the LED 43. As a result, the configuration of the communication board 31 can be simplified compared with cases where the communication circuit 42 and another circuit that controls the light-emitting of the LED 43 are provided separately on the communication board 31.

Second Embodiment

A printer 1 of another embodiment will be described with reference to FIG. 8. The present embodiment differs from the printer 1 of the first embodiment described above in that light emission control circuit 50 for controlling light emission of the LED 43 is provided on the communication board 31 separately from the communication circuit 42. The light emission control circuit 50 is an example of a light emission control unit. In the description below, like parts and components are designated by the same reference numerals to avoid duplicating description.

(1) Configuration of Communication Circuit

Figure 8:
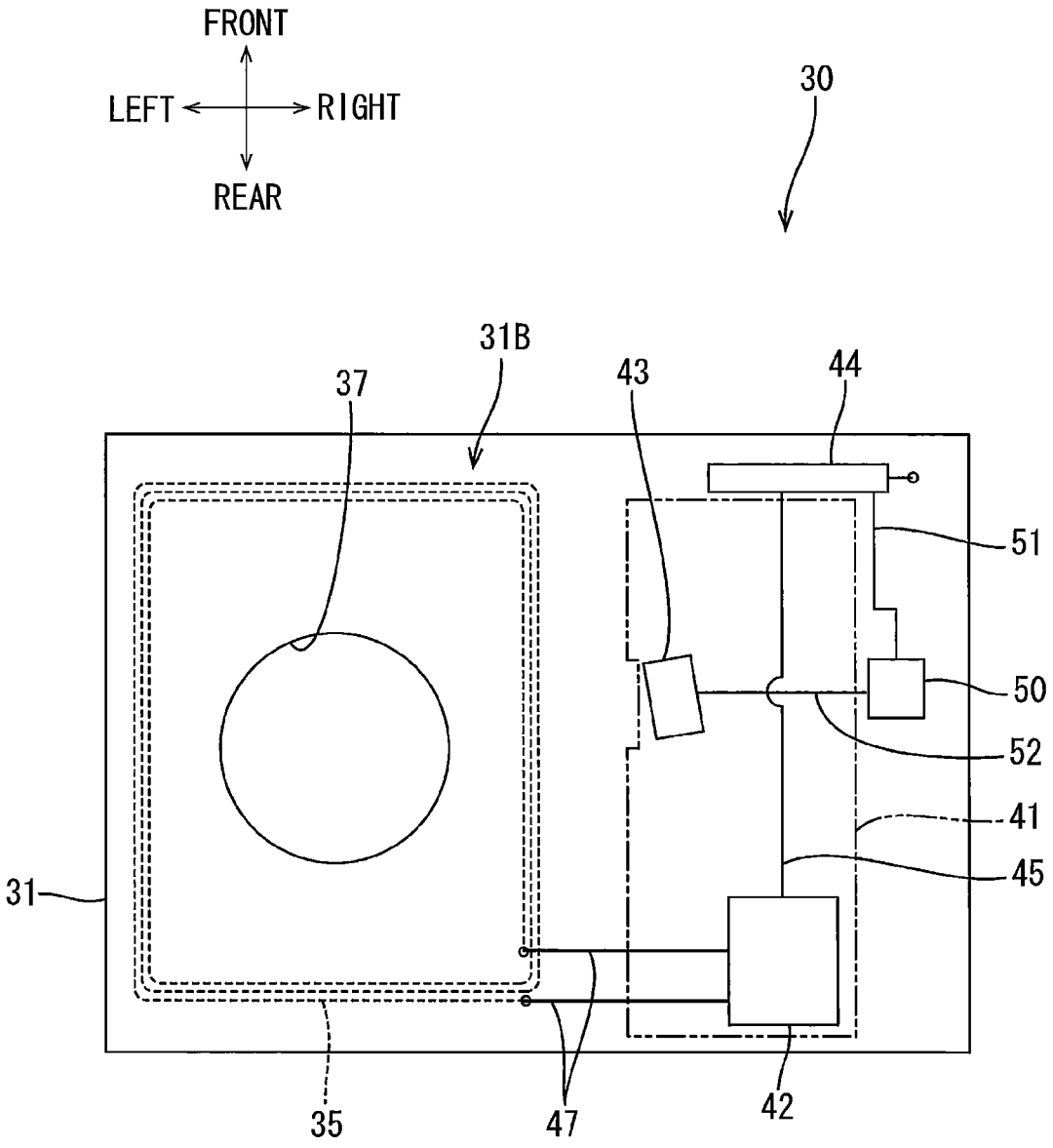
FIG. 8 is a bottom view of a communication board according to a second embodiment.

FIG. 8 shows the lower surface 31B of the communication board 31 according to the present embodiment. The light emission control circuit 50 is disposed in a right end portion of the lower surface 31B of the communication board 31.

The light emission control circuit 50 is mounted outside the looped portion of the loop antenna 35 in such a way as to avoid the antenna 35.

The light emission control circuit 50 is mounted outside the shield 41. The light emission control circuit 50 is connected to the connector 44 via a wire 51. The light emission control circuit 50 generates a light emission control signal on the basis of a light emission command that is input from the control board 25. The light emission control circuit 50 is connected to the LED 43 via a wire 52, and outputs the generated light emission control signal to the LED 43. The wire 52 is another example of the connecting wire.

The light emission control circuit 50 is placed closer to the right end than the shield 41. That is, the light emission control circuit 50 is placed opposite to the antenna 35 with respect to the shield 41. Therefore, the light emission control circuit 50 is placed farther away from the antenna 35 than the shield 41.

(2) Advantageous Effects of the Second Embodiment

According to the present embodiment described above, the light emission control circuit 50 is mounted outside the shield 41. This configuration prevents the light emission control circuit 50 from interfering with the communication circuit 42 compared with cases where both the communication circuit 42 and the light emission control circuit 50 are disposed inside the shield 41. Accordingly, this configuration prevents the communication state of the antenna 35 from being worsened by avoiding such cases as where the results of the near field wireless communication are not correctly output due to the interference.

According to the present embodiment described above, the light emission control circuit 50 is placed opposite to the antenna 35 with respect to the shield 41. This configuration prevents the communication state of the antenna 35 from being worsened even when the light emission control circuit 50 is mounted on the communication board 31.

Third Embodiment

A printer 1 of another embodiment will be described with reference to FIG. 9. The present embodiment differs from the printer 1 of the first and second embodiments described above in that the light emission of the LED 43 is controlled with the use of the control board 25. That is, the present embodiment is different from the printer 1 of the embodiments described above in that no circuit is mounted on the communication board 31 for generating a light emission control signal. In the description below, like parts and components are designated by the same reference numerals to avoid duplicating description.

(1) Configuration of Communication Circuit

Figure 9:
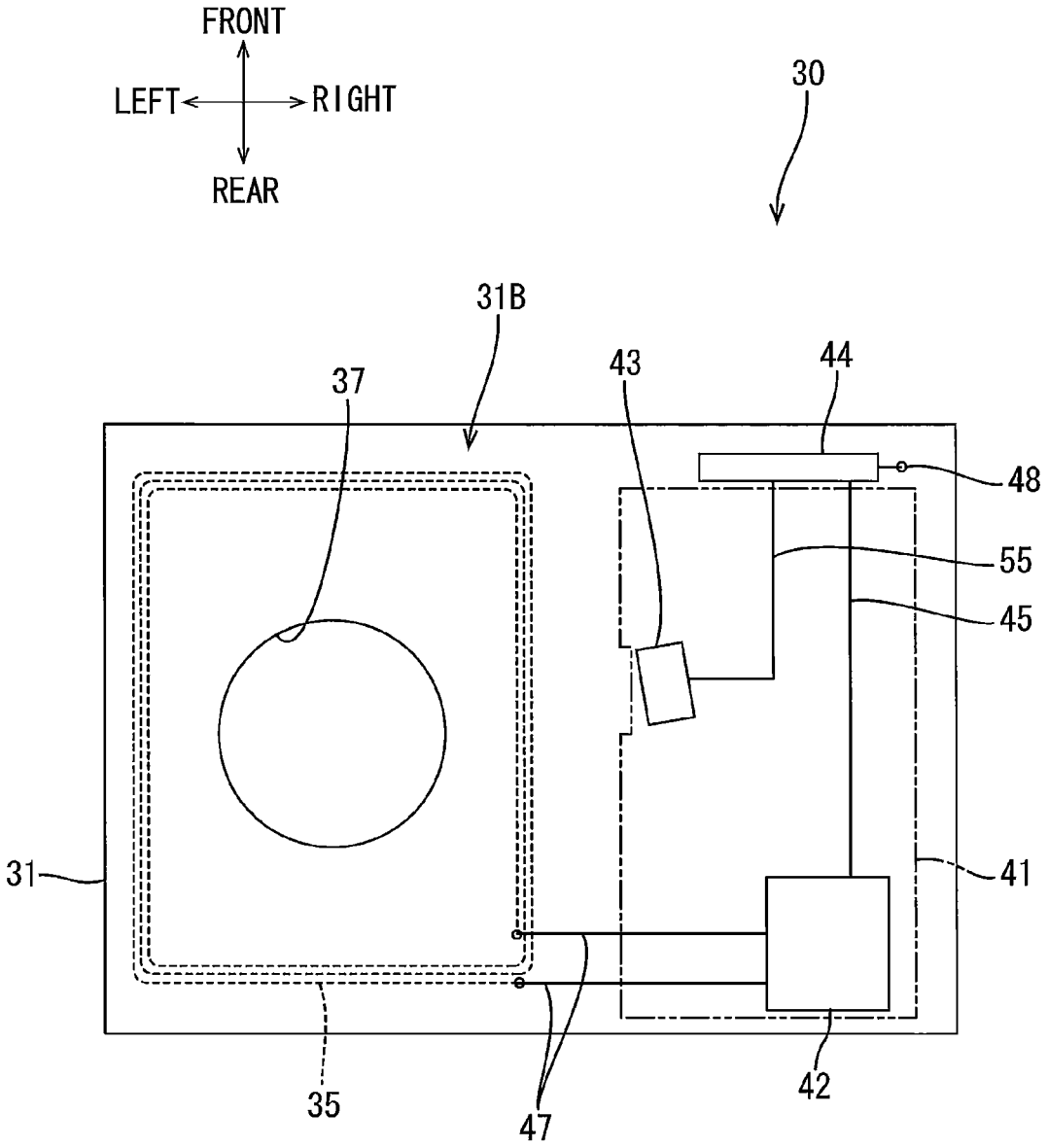
FIG. 9 is a bottom view of a communication board according to a third embodiment.

FIG. 9 shows the lower surface 31B of the communication board 31 according to the present embodiment. The connector 44 is connected to the control board 25, and a light emission control signal is input from the control board 25 to the connector 44. The light emission control signal input to the connector 44 is further input to the LED 43 via a wire 55. The connector 44 is an example of a signal input unit. The wire 55 is another example of the connecting wire.

(2) Advantageous Effects of the Embodiment

According to the present embodiment described above, a circuit that generates a light emission control signal is not placed on the communication board 31. Therefore, the communication board 31 can be made smaller in size. Moreover, the interference between this structure and the communication circuit 42 is suppressed compared with cases where a structure that generates a light emission control signal is disposed on the communication board. Therefore, this configuration prevents the communication state of the antenna 35 from being worsened.

Other Embodiments

While the description has been made in detail with reference to the embodiments thereof, it would be apparent to those skilled in the art that various changes and modifications may be made therein without departing from the spirit and scope of the above described embodiments.

The image processing device is not limited to the printer, but may be a scanner equipped with an image reading unit that reads an image from a document, or a multifunction peripheral that has a print function and a facsimile function, for example.

The light-emitting element is not limited to the LED, but may be a cold cathode lamp and the like.

The light emission surface is not necessarily required to protrude toward the upper surface 31A of the communication board 31, but may be located below the upper surface 31A of the communication board 31.

According to the embodiments described above, the region 17 of the protective cover 27 under which the inner portion of the antenna 35 is located is illuminated by the LED 43. Instead, a region corresponding to the periphery of the antenna 35 may be illuminated. No light guide member 32 may be provided as long as the region corresponding to the periphery of the antenna 35 can be illuminated.

The shape of the light guide member 32 is not limited to that of the embodiments described above, but may be replaced with a different one depending on the position and shape of the light transmission hole 37 provided in the communication board 31 and the position of the LED 43 on the communication board 31.

According to the embodiments described above, the ground voltage is input to the solid pattern. Instead, the power supply voltage may be input to the solid pattern. The light-shielding pattern is not necessarily required to be a wiring pattern, but may be made from light-shielding insulating film or paint.

What is claimed is:

1. A communication device comprising:

a communication board;

an antenna for near field wireless communication provided on the communication board;

a light-emitting element provided on the communication board at a position away from the antenna;

a connecting wire provided on the communication board at a position away from the antenna and connected to the light-emitting element; and a light guide member configured to guide light emitted from the light-emitting element to the antenna.

2. The communication device according to claim 1, wherein the antenna has a looped portion;

wherein the light-emitting element and the connecting wire are disposed outside the looped portion of the antenna; and wherein the light guide member has:

a light incident surface disposed outside the looped portion of the antenna and opposed to the light-emitting element; and a light emission surface disposed inside the looped portion of the antenna.

3. The communication device according to claim 2, further comprising:

a communication control unit disposed on the communication board and outside the looped portion of the antenna, the communication control unit being connected to the antenna and configured to control communication via the antenna; and a shield member formed over the communication control unit and the light-emitting element.

4. The communication device according to claim 3, wherein the shield member has a cutout portion allowing the light guide member to extend therethrough to position the light incident surface close to the light-emitting element.

5. The communication device according to claim 3, wherein the communication board has one surface on which the antenna is disposed, and another surface on which the light-emitting element and the communication control unit are disposed;

wherein the communication board has an aperture positioned inside the looped portion of the antenna; and wherein the light guide member is disposed on the another surface and is configured to guide the light toward the one surface through the aperture.

6. The communication device according to claim 5, wherein the light guide member has a portion extending through the aperture such that the light emission surface is positioned on the one surface of the communication board.

7. The communication device according to claim 5, wherein the light-emitting element has a light-emitting surface disposed on the another surface of the communication board and opposed to the antenna; and wherein the one surface of the communication board has a region corresponding to the light-emitting surface and the region having a light-shielding pattern.

8. The communication device according to claim 7, further comprising a power input unit disposed on the another surface of the communication board and outside the looped portion of the antenna, the power input unit being configured to receive a power-supply voltage and ground voltage for driving the communication control unit from an outside of the communication board; and wherein the light-shielding pattern is connected to the power input unit such that one of the power-supply voltage and the ground voltage is input to the light-shielding pattern.

9. The communication device according to claim 3, wherein the communication board is rectangular in shape having long sides and short side, the communication board having one end portion and another end portion in a direction of the long sides, and having an end portion in a direction of the short sides;

wherein the antenna is disposed on the one end portion of the communication board;

wherein the communication control unit is disposed on the another end portion and the end portion of the communication board; and wherein the light-emitting element is disposed on the another end portion and the end portion of the communication board.

10. The communication device according to claim 3, wherein the communication control unit is configured to output a light emission control signal to the light-emitting element via the connecting wire for controlling light emission of the light-emitting element.

11. The communication device according to claim 3, further comprising a light emission control unit disposed on the communication board and outside the looped portion of the antenna, and disposed outside the shield member, the light emission control unit being configured to output a light emission control signal to the light-emitting element via the connecting wire for controlling light emission of the light emitting element.

12. The communication device according to claim 11, wherein the light emission control unit is disposed opposite to the antenna with respect to the shield member.

13. The communication device according to claim 3, further comprising a signal input unit disposed on the communication board and outside the looped portion of the antenna, the signal input unit being configured to receive a light emission control signal from an outside of the communication board for controlling light emission of the light-emitting element;

wherein the connecting wire is connected to the signal input unit; and wherein the light emission control signal is input to the light-emitting element via the connecting wire.

14. An image forming apparatus comprising:

a communication device comprising:

a communication board;

an antenna for near field wireless communication provided on the communication board;

a light-emitting element provided on the communication board at a position away from the antenna; and a connecting wire provided on the communication board at a position away from the antenna and connected to the light-emitting element;

a light guide member configured to guide light emitted from the light-emitting element to the antenna; and an image processing unit configured to perform at least one of reading images and forming images.

* * * * *